US009546410B2

(12) United States Patent
Mizuta et al.

(10) Patent No.: US 9,546,410 B2
(45) Date of Patent: Jan. 17, 2017

(54) BRONZE ALLOY FOR MUSICAL INSTRUMENT, AND PERCUSSION INSTRUMENT USING THE SAME

(71) Applicants: OSAKA ALLOYING WORKS, CO., LTD, Fukui-shi, Fukui (JP); Koide Works Limited, Osaka-shi, Osaka (JP)

(72) Inventors: Taiji Mizuta, Fukui (JP); Yasunari Mizuta, Fukui (JP); Wataru Ogawa, Fukui (JP); Toshio Koide, Osaka (JP); Mizue Kakehi, Fukui (JP)

(73) Assignees: Osaka Alloying Works, Co., Ltd., Fukui-shi (JP); Koide Works Limited, Osaka-shi (JP)

( * ) Notice: Subject to any disclaimer, the term of this patent is extended or adjusted under 35 U.S.C. 154(b) by 0 days.

(21) Appl. No.: 14/947,512

(22) Filed: Nov. 20, 2015

(65) Prior Publication Data

US 2016/0258039 A1 Sep. 8, 2016

(30) Foreign Application Priority Data

Mar. 4, 2015 (JP) ..... 2015-041909

(51) Int. Cl.
*G10D 13/06* (2006.01)
*C22C 9/02* (2006.01)

(52) U.S. Cl.
CPC ..... *C22C 9/02* (2013.01); *G10D 13/06* (2013.01)

(58) Field of Classification Search
CPC ..... G10D 13/00; G10D 1/005; G10D 7/005; G10D 9/00; G10K 1/07; G10K 3/00; G10K 15/04; G10K 1/26; G10K 11/18; G10K 1/072; G10K 1/08; G10K 1/10; B22F 2998/10; B22F 3/02; B22F 3/10; B22F 3/26
USPC ..... 84/402–410
See application file for complete search history.

(56) References Cited

U.S. PATENT DOCUMENTS

2009/0107319 A1* 4/2009 Stannard ..... G10D 13/06 84/402
2014/0041506 A1* 2/2014 Jones ..... G10D 3/10 84/297 S

* cited by examiner

*Primary Examiner* — Kimberly Lockett
(74) *Attorney, Agent, or Firm* — Sughrue Mion, PLLC

(57) ABSTRACT

The present invention aims at providing bronze alloy for a musical instrument that has high strength and processability and is provided with excellent acoustic characteristics by addition of Zr. The bronze alloy for a musical instrument according to the present invention has a component composition that contains 18% by mass to 26% by mass of Sn, 0.0005% by mass to 0.25% by mass of Zr, and a remainder consisting of Cu and inevitable impurities. Bronze alloy for a musical instrument having high strength and processability is obtained by setting the component composition as described above. Furthermore, from the frequency analysis result shown in FIG. 6A, in Example 13, higher harmonic components increase and low frequency waves also increase as compared with Comparative Example 2, and it is known that the enhancement of sound qualities such as complexity of beat sounds, profound feeling, and audibility is obtained.

8 Claims, 7 Drawing Sheets

0.5sec 1.0sec 1.5sec 2.0sec

BRONZE ALLOY FOR MUSICAL INSTRUMENT, AND PERCUSSION INSTRUMENT USING THE SAME

BACKGROUND OF THE INVENTION

Field of the Invention

The present invention relates to a bronze alloy for a musical instrument having excellent acoustic characteristics, high strength and improved processability, through micronization of crystal grains by the addition of zirconium (Zr).

Related Background of the Invention

Cu—Sn-based copper alloys containing copper (Cu) and tin (Sn) as main components are known as bronze, and in particular, alloys in which a Sn concentration exceeds 20% by mass is referred to as bell metal from olden times. There are a cymbal and a church bell as traditional instruments, and the enhancement of a sound quality has been achieved by containing silver (Ag) or iron (Fe), from a long time ago.

In Cu—Sn-based copper alloys, the larger a Sn concentration becomes, the more acoustic characteristics are enhanced, but processing thereof becomes difficult. Therefore, when copper alloys in which a Sn concentration is 18% by mass or less are to be processed, a processing method such as rolling or forging is used. When copper alloys in which a Sn concentration exceeds 18% by mass are to be processed, casting processing is used. Until now, when trying to enhance quality of a musical instrument using a copper alloy and to obtain different acoustic characteristics, the improvement in a molding process and a shape of the instrument is carried out. However, copper alloys itself to be used for instruments have not largely improved, and copper alloys having a Sn concentration of 18% by mass or more and having improved processability are not proposed (refer to Patent Literature 1).

The present inventors have proposed the increase of a Sn concentration in a Cu—Sn-based copper alloy to 23% by mass from the viewpoint of putting importance on acoustic characteristics and the addition of titanium (Ti) that is an active metal in order to improve rolling and molding processability (refer to Non-patent Literature 1). It is possible to perform molding processing on a cymbal by enhancing processability of a bell metal material having a Sn concentration exceeding 18% by mass, and thus it becomes possible to develop instruments of high sound quality having a complex and profound sound. The technology of adding Ti that is an active metal to a Cu—Sn-based copper alloy was heretofore practiced by a vacuum melting method, but it becomes possible to realize Cu—Sn-based copper alloys having such a composition by using a manufacturing method that makes it possible to cast a copper alloy by melting a copper alloy material in the air (refer to Patent Literature 2; hereinafter referred to as the "Mizuta system").

The metal structure of Cu—Sn-based copper alloys is an aggregate of crystals, and a part surrounded by a boundary surface of crystals (crystal grain boundary) is referred to as a crystal grain. The dimension of the crystal grain is generally represented by a crystal granularity or a crystal grain diameter. In a Cu—Sn-based copper alloy manufactured by the Mizuta system, although the processability is enhanced, the cross-sectional area of a crystal grain is as coarse as 1 $mm^2$ to 10 $mm^2$, and thus there is a problem in which the alloy is easily broken when being used as cymbals. Namely, it is considered that, since a hot rolling temperature of a Cu—Sn-based copper alloy containing 23% by mass of Sn having almost no processability is set to be high, the processing is performed at the secondary recrystallization temperature and the crystal grain has become coarse. As the result, the metal structure has become easily broken along the crystal grain boundary, and a cymbal may be broken depending on the magnitude of force of striking the cymbal or the method of striking the cymbal. As to the micronization of crystal grains, Patent Literature 3 describes that crystal grains are micronized by adding an element other than the main component such as Zr to a phosphor bronze alloy in semi-melting alloy casting process.

PRIOR ART

Patent Literature

[Patent Literature 1] Japanese Patent No. 2596981
[Patent Literature 2] Japanese Patent No. 3040768
[Patent Literature 3] Japanese Unexamined Patent Publication No. 2007-211324

Non-Patent Literature

[Non-patent Literature 1] Mizuta Taiji, and other six members, "Cooperation Business on Domestic Production of Cymbals Material and Kind Diversification," SOKEIZAI CENTER, SOKEIZAI, vol. 54, No. 12, pp 52 to 58, December 2013

SUMMARY OF THE INVENTION

Problems to be Solved by Invention

In order to deal with the problem in which the bronze alloy for a musical instrument described in Non-patent Literature 1 is easily broken, the present inventors carried out research and development for micronizing crystal grains by adding an element other than the main component to a Cu—Sn-based copper alloy. As the result, micronization of crystal grains became possible by adding Zr to a Cu—Sn-based copper alloy, and a bronze alloy for a musical instrument having excellent acoustic characteristics, high strength and enhanced processability was able to be obtained.

Means for Solving Problems

A bronze alloy for a musical instrument according to the present invention has a component composition containing 18% by mass to 26% by mass of Sn, 0.0005% by mass to 0.25% by mass of Zr, and the remainder consisting of Cu and inevitable impurities.

A bronze alloy for a musical instrument according to the present invention has a component composition containing 18% by mass to 26% by mass of Sn, 0.0005% by mass to 0.25% by mass of Zr, and additionally, one kind or two kinds of 0.1% by mass to 1.0% by mass of Ti and 0.001% by mass to 1.0% by mass of P, and the remainder consisting of Cu and inevitable impurities.

The above-described bronze alloys for a musical instrument have a component composition further containing one kind or two kinds of Ag: 0.005% by mass to 0.1% by mass and Fe: 0.01% by mass to 0.1% by mass.

Effects of the Invention

The bronze alloy for a musical instrument according to the present invention has high strength and processability and is provided with excellent acoustic characteristics, as the result of having the above-described configuration. Namely, the added Zr serves as Zr fine intermetallic compounds, which are discretely distributed, with the result that the enhancement of mechanical properties becomes possible. In addition, it becomes possible to adjust attenuation characteristics of sound while maintaining complexity and profound feeling of sound as a musical instrument, and to realize excellent acoustic characteristics.

DESCRIPTION OF THE PREFERRED EMBODIMENTS

Figure 1:
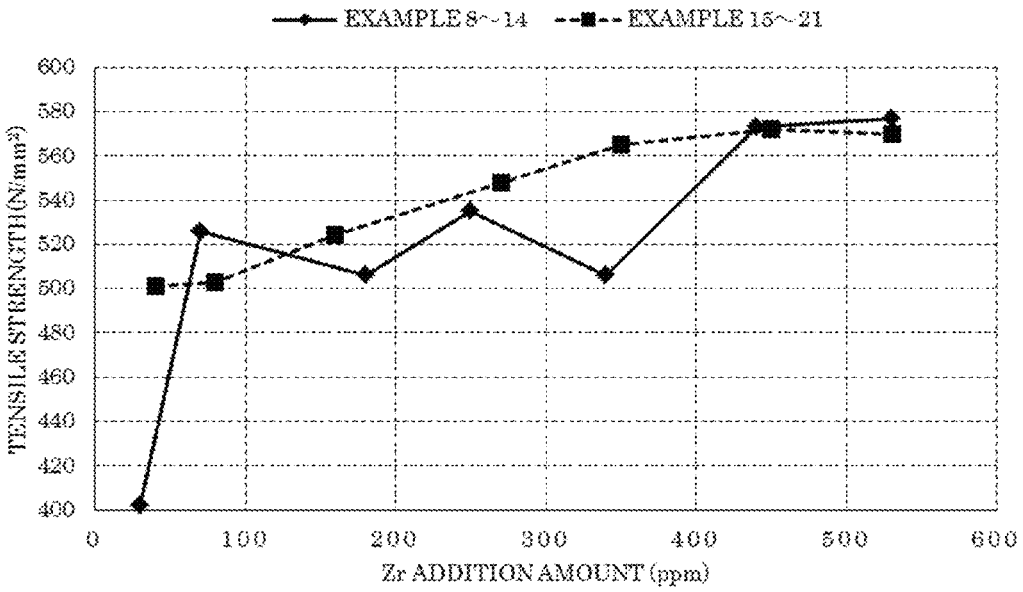
FIG. 1 is a line graph showing tensile strength in Examples 8 to 21.

The present invention will be described in detail below. A bronze alloy for a musical instrument according to the present invention contains Zr of 0.0005% by mass to 0.25% by mass in a Cu—Sn-based copper alloy containing Sn of 18% by mass to 26% by mass, and since the Zr are dispersed as fine intermetallic compounds, the crystal grain is micronized. The size of the crystal grain is preferably micronized to be 100 $\mu m^2$ to 300 $\mu m^2$ in terms of a cross-sectional area. Through micronization of crystal grains, processability can be enhanced with high strength, with the result that a metal structure not easily broken is generated. Furthermore, when the alloy is used for a musical instrument, the preservation or enhancement of sound quality can be achieved, and is provided with excellent acoustic characteristics. The bronze alloy for a musical instrument can be manufactured by the Mizuta system. In the Mizuta system, the inside of a graphite crucible is shielded with argon gas at the time of melting copper alloy raw materials, and after the start of the melting, the surface of a molten metal is covered with carbon small pieces or carbon powder, or a carbon-based flux. Then, after melting the copper alloy raw materials in the graphite crucible, the molten metal was solidified in one direction by rapidly cooling the molten metal from the bottom part, with the result that the bronze alloy for a musical instrument is manufactured.

In the present invention, by adding Ti and P in a prescribed range of content to the above-described component composition of Cu—Sn—Zr, as necessary, a bronze alloy for a musical instrument that has high strength and processability and that is excellent in acoustic characteristics can be obtained. In the Mizuta system, there is held the temperature (1,050° C. to 1,100° C.) that is higher than the melting point of a Cu—Sn-based alloy (800° C. to 900° C.) by approximately 200° C. to 250° C. and thus Ti, P and Zr are completely melted. Then, casting can be performed in the air in a state where Ti and Zr being active metals are contained by cooling the molten metal in the crucible with water from the bottom part to thereby solidify the same.

Crystal grains of the obtained bronze alloy for a musical instrument are micronized so that each of the gains has a cross-sectional area of 100 $\mu m^2$ to 300 $\mu m^2$, and are discretely distributed in a size each having a cross-sectional area of 1 $\mu m^2$ to 20 $\mu m^2$ by the fact that the contained Zr becomes Zr intermetallic compounds. Therefore, it is possible to enhance mechanical properties of the bronze alloy for a musical instrument, and it becomes possible to adjust attenuation characteristics while maintaining complexity and profound feeling of sounds.

The bronze alloy for a musical instrument has a component composition containing 18% by mass to 26% by mass of Sn and 0.0005% by mass to 0.25% by mass of Zr, and the remainder consisting of Cu and inevitable impurities. Furthermore, the bronze alloy may be set to contain one kind or two kinds of 0.1% by mass to 1.0% by mass of Ti and 0.001% by mass to 1.0% by mass P. As described above, such a Cu—Sn-based copper alloy can achieve high strength by micronization of crystal grains and the enhancement of processability, can achieve the preservation or enhancement of sound quality, and is provided with excellent acoustic characteristics.

In the above-described bronze alloy for a musical instrument, one kind or two kinds of 0.005% by mass to 0.1% by mass of Ag and 0.01% by mass to 0.1% by mass of Fe can be further contained. Ag and Fe are well known components contained in a conventional bronze alloy for a musical instrument, and such well known i components may also be contained.

In a molded percussion instrument by using the bronze alloy for a musical instrument, hardness can be adjusted by adjustment of the addition amount of Zr and P. Therefore, acoustic characteristics such as frequency distribution and attenuation characteristics of beat sounds generated when a percussion instrument is struck can be adjusted. Namely, by adjustment of the frequency distribution of beat sounds, noise components are reduced so that higher harmonic components of beat sounds become clearer, and high sound qualities such as complexity of sounds, profound feeling and easy audibility can be obtained. Furthermore, characteristics to adjust reverberation time or characteristics of easily sounding by making energy of sounds immediately after stroke large can be realized by adjustment of attenuation characteristics of beat sounds.

The reason why the components are limited as described above as to the bronze alloy for a musical instrument according to the present invention will be explained below.

Sn:

Sn has a function of enhancing mechanical properties and sound quality by being added to Cu. However, when the content thereof is less than 18% by mass, not only is complexity or profound feeling not given to sounds but also the alloy is easily broken during hot rolling to thereby make the processing difficult, which is not preferable. Furthermore, when the content thereof exceeds 26% by mass, elongation is eliminated to thereby make molding difficult, which is not preferable. Accordingly, a bronze alloy for a musical instrument having high strength and processability can be obtained by setting the content of Sn to be 18% by mass to 26% by mass.

Zr:

Zr can enhance mechanical properties and adjust hardness of the bronze alloy for a musical instrument, by micronizing crystal grains of a cast Cu—Sn-based copper alloy casting and by fine dispersion of Zr. In addition, the adjustment of acoustic characteristics such as frequency distribution and attenuation characteristics of beat sounds when being used as a percussion instrument becomes possible by adjusting the hardness. However, when the content thereof is less than 0.0005% by mass, micronization of crystal grains becomes insufficient, which is not preferable. Furthermore, when the content exceeds 0.25% by mass, the intermetallic compound of Zr are dispersed to thereby advance hardening, and molding becomes difficult and a sound immediately attenuates and is not generated, which is not preferable. Accordingly, a bronze alloy for a musical instrument having high strength and processability and being provided with excellent acoustic characteristics can be obtained by setting the content of Zr to be 0.0005% by mass to 0.25% by mass.

Ti:

Ti has an action of enhancing rolling and molding processability by addition to a bronze alloy for a musical instrument. Furthermore, when the alloy is used as a percussion instrument, Ti has an action of generating plenty of sounds having frequency components of 5,000 Hz or less to thereby enhance acoustic characteristics by giving complexity and profound feeling to the sound. However, when the content is less than 0.1% by mass, sufficient effect of enhancing processability and acoustic characteristics cannot be obtained, which is not preferable. In addition, when the content thereof exceeds 1.0% by mass, acoustic characteristics does not change largely and the lowering of mechanical properties is caused by generating carbide and oxide of Ti in melting/casting, which is not preferable. Accordingly, a bronze alloy for a musical instrument having enhanced processability and enhanced acoustic characteristics can be obtained by containing Ti in an amount of 0.1% by mass to 1.0% by mass, as necessary.

P:

Addition of P to a bronze alloy for a musical instrument makes it possible to adjust the hardness, and P has an action of adjusting attenuation characteristics of sound when the alloy is used as a percussion instrument, by being added together with Zr. However, when the content thereof is less than 0.001% by mass, a sufficient effect caused by adjustment of hardness cannot be obtained, which is not preferable. Furthermore, when the content exceeds 1.0% by mass, the alloy is embrittled by generating an intermetallic compound having a low melting point, and when the alloy is used as a percussion instrument, sounds attenuate immediately and a sound is not to be generated, which is not preferable. Accordingly, a bronze alloy for a musical instrument having enhanced acoustic characteristics by adjustment of hardness can be obtained by containing P in an amount of 0.001% by mass to 1.0% by mass, as necessary.

Other Components (Ag, Fe)

Well known components such as Ag and Fe which are contained in the conventional bronze alloys for a musical instrument can be further contained in the bronze alloy for a musical instrument, as required. The content of Ag is, as in the conventional way, preferably 0.005% by mass to 0.1% by mass, and the content of Fe is, also as in the conventional way, preferably 0.01% by mass to 0.1% by mass.

Examples

Hereinafter, Examples of the bronze alloy for a musical instrument according to the present invention will be explained. Each composition of components in Examples is shown in Table 1. Examples 1 to 7 are examples of containing Zr and P other than Cu and Sn, Examples 8 to 14 are examples of containing Zr alone other than Cu and Sn, Examples 15 to 21 are examples of containing Zr and Ti other than Cu and Sn, and Examples 22 to 24 are examples of containing Zr, Ti and P other than Cu and Sn.

TABLE 1

| | No. | Sn | Ti | Zr | P | Cu | DIMENSION (DIAMETER) |
|---|---|---|---|---|---|---|---|
| | | CONTAINING Zr AND P (% by mass) | | | | | |
| EXAMPLE | 1 | 20.05 | — | 0.035 | 0.004 | REMAINDER | 500 mm |
| | 2 | 20.02 | — | 0.036 | 0.078 | REMAINDER | 500 mm |
| | 3 | 20.06 | — | 0.074 | 0.008 | REMAINDER | 500 mm |
| | 4 | 19.95 | — | 0.073 | 0.078 | REMAINDER | 500 mm |
| | 5 | 20.07 | — | 0.112 | 0.078 | REMAINDER | 500 mm |
| | 6 | 20.12 | — | 0.15 | 0.076 | REMAINDER | 500 mm |
| | 7 | 20.08 | — | 0.186 | 0.077 | REMAINDER | 500 mm |
| | | CONTAINING Zr ALONE (% by mass) | | | | | |
| | 8 | 22.99 | — | 0.003 | — | REMAINDER | 400 mm |
| | 9 | 23.07 | — | 0.007 | — | REMAINDER | 400 mm |
| | 10 | 23 | — | 0.018 | — | REMAINDER | 400 mm |
| | 11 | 23.15 | — | 0.025 | — | REMAINDER | 400 mm |
| | 12 | 22.96 | — | 0.034 | — | REMAINDER | 400 mm |
| | 13 | 23.01 | — | 0.044 | — | REMAINDER | 400 mm |
| | 14 | 23.04 | — | 0.053 | — | REMAINDER | 400 mm |
| | | CONTAINING Ti AND Zr (% by mass) | | | | | |
| | 15 | 23.15 | 0.287 | 0.004 | — | REMAINDER | 400 mm |
| | 16 | 23.11 | 0.293 | 0.008 | — | REMAINDER | 400 mm |
| | 17 | 23.08 | 0.292 | 0.016 | — | REMAINDER | 400 mm |
| | 18 | 23.04 | 0.287 | 0.027 | — | REMAINDER | 400 mm |
| | 19 | 23.19 | 0.299 | 0.035 | — | REMAINDER | 400 mm |

TABLE 1-continued

| | No. | Sn | Ti | Zr | P | Cu | DIMENSION (DIAMETER) |
|---|---|---|---|---|---|---|---|
| | 20 | 23.01 | 0.289 | 0.045 | — | REMAINDER | 400 mm |
| | 21 | 23.07 | 0.289 | 0.053 | — | REMAINDER | 400 mm |
| | | CONTAINING Ti, Zr AND P (% by mass) | | | | | |
| | 22 | 23.09 | 0.294 | 0.018 | 0.002 | REMAINDER | 400 mm |
| | 23 | 23.01 | 0.283 | 0.026 | 0.003 | REMAINDER | 400 mm |
| | 24 | 22.95 | 0.289 | 0.035 | 0.004 | REMAINDER | 400 mm |
| COMPARATIVE | 1 | 23.14 | 0.286 | — | — | REMAINDER | 400 mm |
| EXAMPLE | 2 | 20.01 | — | — | — | REMAINDER | 400 mm |
| | 3 | 20.5 | — | 0.291 | 0.03 | REMAINDER | 400 mm |

<Production of Bronze Alloy for a Musical Instrument>

When manufacturing the bronze alloy for a musical instrument, bronze alloy materials (Cu, Sn) having the component composition shown in Table 1 are molten, in the air, with a high-frequency melting furnace (manufactured by Fuji Electric Co., Ltd.) under an argon (Ar) gas atmosphere and charcoal covering. Zr and Ti are added at a time point when the bronze melting temperature in the melting furnace becomes 1,050° C. to 1,100° C. P, Ag and Fe are added after adding Zr. A molten bronze alloy obtained by adding materials corresponding to necessary component composition was cast, with the result that a bronze alloy for a musical instrument made of an ingot of 110 mm in diameter and 150 mm in height was produced.

The produced ingot was cut out into a size of 110 mm in diameter and 34 mm in height, which was subjected to hot cross rolling at 720° C. with a hot rolling machine (manufactured by TOPPLANT-ENG Co., LTD.), with the result that a material having an approximately disc-like shape of from 430 mm to 450 mm in diameter and about 2 mm in thickness and a material having an approximately disc-like shape of 530 mm in diameter and about 0.9 mm in thickness were molded and then air-cooled.

<Molding Processing of Cymbal>

Next, in order to make the obtained material into a shape of a cymbal being a percussion instrument, the central cup part was molded by hot pressing with a hot pressing machine (manufactured by KOIDE CO., LTD.), which was charged into water at about 730° C. to be rapidly cooled, and after that, was cut out so as to give a disc shape of 400 mm in diameter or 500 mm in diameter. The obtained molding material was molded into a cymbal by metal spinning processing, and an oxide film formed on the surface of the formed cymbal was removed by cutting to thereby produce two kinds of cymbals of 400 mm in diameter and 1.5 mm in thickness and of 500 mm in diameter and 1.2 mm in thickness.

Comparative Examples

In Comparative examples 1 and 3, ingots of the component composition shown in Table 1 were produced in the same way as that in Example, which were molded into a cymbal shape in the same way as Example, with the result that cymbals of 40 mm in diameter and 1.5 mm in thickness were produced.

A commercially available cymbal was used for Comparative example 2. Such a cymbal is produced mainly using a copper alloy material such as 8% phosphor bronze or 20% tin bronze to which no Zr is added. As a production method, a manufacturing method using yudoko metal melting in which casting and hot rolling are performed one by one on a metallic mold filled with hot water, or a manufacturing method in which one processed into a thin and long sheet shape is cut out in a disc shape is used. In these conventional manufacturing methods, variation in Sn concentration is large and variation in qualities regarding mechanical properties and acoustic characteristics of cymbals become large. A cymbal used for Comparative example 2 was constituted of a bronze alloy having a component composition of Sn concentration of 20%. The size of the cymbal was 40 mm in diameter and 1.5 mm in thickness.

<Tensile Test>

As to cymbals in Examples and Comparative examples shown in Table 1, a tensile test was performed in accordance with Metallic materials—Tensile testing—Method of test at room temperature (JIS Z 2241). First, a test piece was made by cutting out a part of each of molded cymbals. The test piece was formed in a dumbbell shape having such dimension as 30 mm in a parallel part, 25 mm in distance between evaluation points, and 10 mm in width. In the tensile test, a tensile test machine (manufactured by Shimadzu Corporation) was used, and tensile strength ($N/mm^2$) and elongation percentage (%) were measured. Measurement results are shown in Table 2. The tensile strength shows the strength of a material, and the elongation percentage shows that the test piece is provided with molding processability. Furthermore, in FIGS. 1 and 2, the tensile strength and elongation percentage in Examples 8 to 21 are shown by line graphs, respectively, whose horizontal axes show the addition amount of Zr and vertical axes show the tensile strength and the elongation percentage, respectively.

<Measurement of Crystal Grain Diameter>

Figure 3:
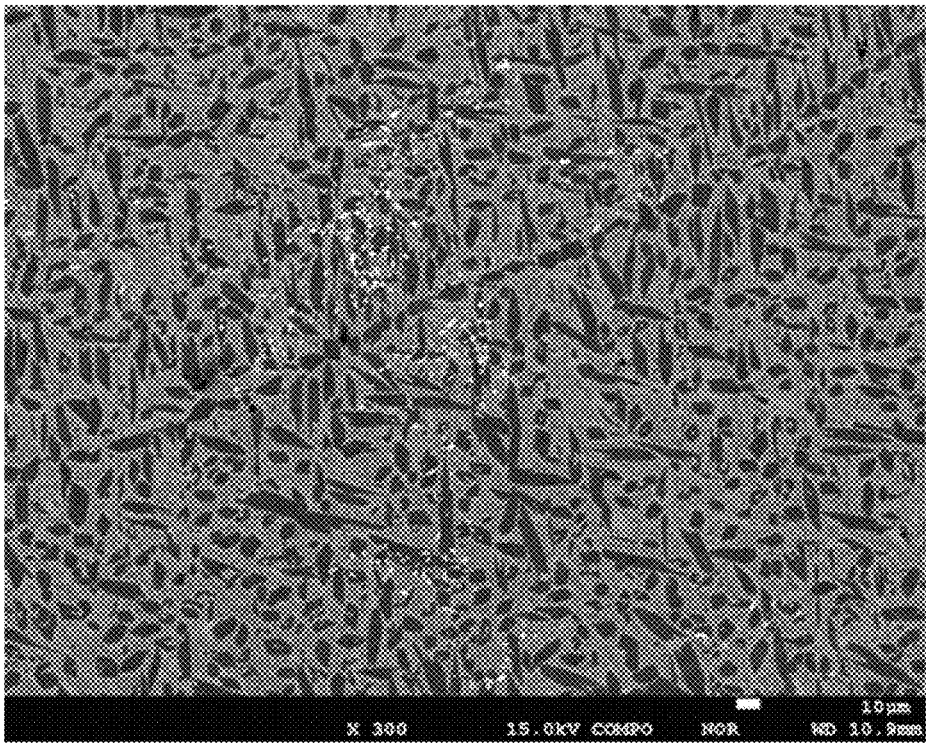
FIG. 3 is a captured photograph when performed microstructure observation for Example 13.

As to each of cymbals in Examples and Comparative examples shown in Table 1, a cross-sectional area was observed with an electron microscope (manufactured by JEOL Ltd.) and the grain diameter of a crystal grain was measured. First, a molded cymbal was cut out in a radius direction and a cut-out test piece (10 mm to 12 mm square) was buried and fixed in phenol resin. As to the cross-section of a test piece buried in resin, microstructure observation was performed using an electron microscope, and the grain diameter of the intermetallic compound of Zr was analyzed. The grain diameter was calculated as the diameter of a virtual circle having the same area as the cross-sectional area of the intermetallic compound. The grain diameter was measured and calculated using the scale of the electron microscope, and measurement results of 10 points were averaged, which was defined as a grain diameter value. FIG. 3 is a captured photograph obtained by microstructure observation, as to Example 13. In FIG. 3, black parts show the α-phase and gray parts show the β-phase. Dotted white parts show the intermetallic compound of Zr, from which the appearance of dispersion of fine intermetallic compounds was confirmed.

Figure 4:
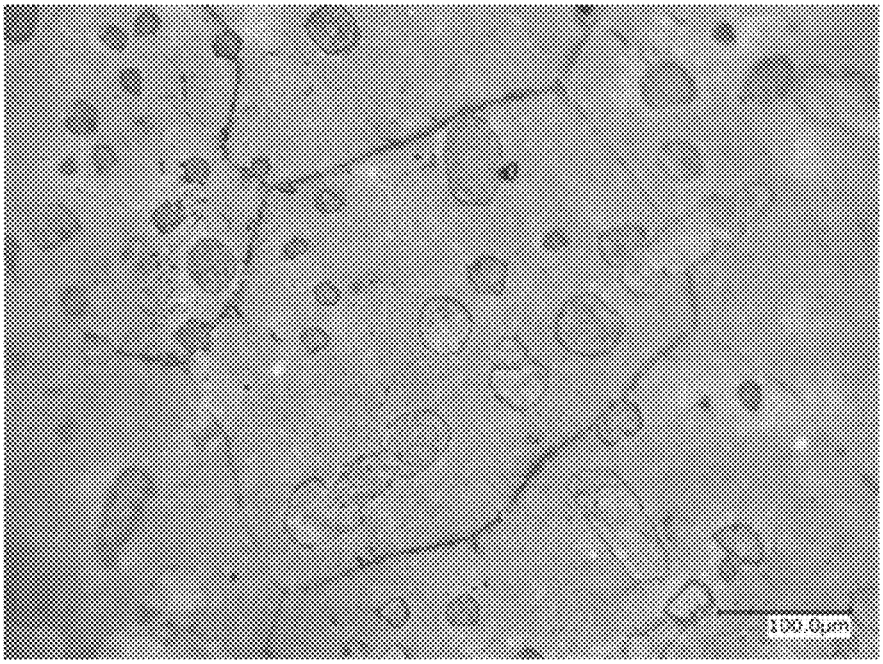
FIG. 4 is a captured photograph when performed microstructure observation for Example 11.

Furthermore, the cross-section of the test piece was etched using a treatment liquid obtained by diluting sulfuric acid and hydrogen peroxide with water, which was subjected to macrostructure observation with a microscope (manufactured by Keyence Corporation), and the diameters of crystal grains at three positions per 10 $mm^2$ were analyzed. The grain diameter was calculated as the diameter of a virtual circle having the same area as the cross-sectional area of the crystal grain, and the average value of calculated grain diameters was defined as an average crystal grain diameter. Obtained average crystal grain diameters are shown in Table 2. FIG. 4 is a captured photograph obtained by macrostructure observation as to Example 11. In FIG. 4, parts surrounded by a black line are crystal grains.

<Measurement of Hardness>

There was measured hardness of cymbals in Examples and Comparative examples shown in Table 1. A test piece was made by cutting out a part of each of molded cymbals in an appropriate size, and the hardness of the obtained test piece was measured using a Vickers hardness meter (manufactured by Akashi Co., Ltd.). Measurement results are shown in Table 2. The hardness shows the strength of the material and durability against stroke.

<With Regard to Mechanical Properties>

Figure 2:
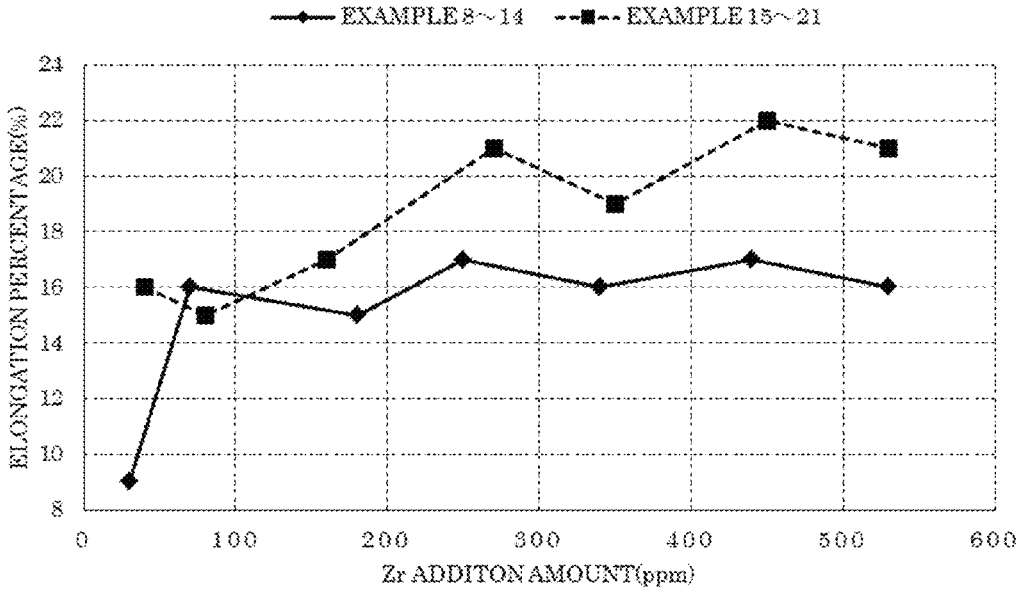
FIG. 2 is a line graph showing elongation percentage in Examples 8 to 21.

In Examples, tensile strength and elongation percentage are at the same level as Comparative example 2 being a conventional product or become larger than Comparative example 2 being a conventional product, and it is known that strength is high and processability is enhanced. Furthermore, as shown in FIGS. 1 and 2, since a positive correlation can be seen between the addition amount of Zr, and tensile strength and elongation percentage, mechanical properties of the bronze alloy for a musical instrument can be adjusted by the addition amount of Zr. However, in Comparative example 3, when the addition amount of Zr exceeds 0.25% by mass, acoustic characteristics begin to deteriorate, as will be described later.

Moreover, in Examples, hardly broken mechanical properties are provided by micronizing the average crystal grain diameter as compared with Comparative example 1. In the case of adding Zr and P as in Examples 1 to 7, tensile strength, elongation percentage and hardness become larger than in the case of adding Zr alone as in Examples 8 to 14, and mechanical properties can be adjusted by the addition of P. In addition, in the case of adding Zr and Ti as in Examples 15 to 21, the hardness becomes smaller than in the case of adding Zr alone, and mechanical properties can be adjusted by the addition of Ti. As described above, mechanical properties of the bronze alloy for a musical instrument can be finely adjusted and acoustic characteristics can be enhanced as will be described later, by adding P and/or Ti other than Zr.

<Test Regarding Acoustic Characteristics>

Tests relating to acoustic characteristics were performed on cymbals in Examples and Comparative examples shown in Table 1. First, a PULSE audio analyzer (3560-C-T00, manufactured by Bruel & Kjar) and microphones (4193 and 2269, manufactured by Bruel & Kjar) were set in an anechoic room (established in Industrial Technology Center of Fukui Prefecture). A cymbal was attached to a support device (SONOR DRUM HARDWARE), and was arranged toward the microphone. Beat sounds were measured by striking the cymbal through the use of a device striking the cymbal with a constant force (manufactured by TOYO Corporation).

Figure 5A:
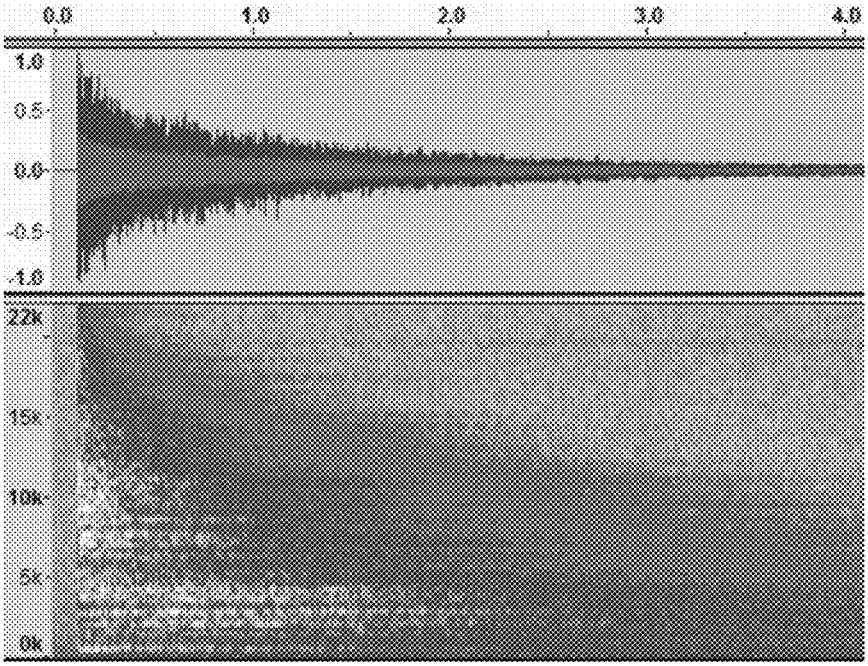
FIG. 5A is a graph showing output results of beat sounds regarding Example 13 and Comparative example 2.
Figure 5B:
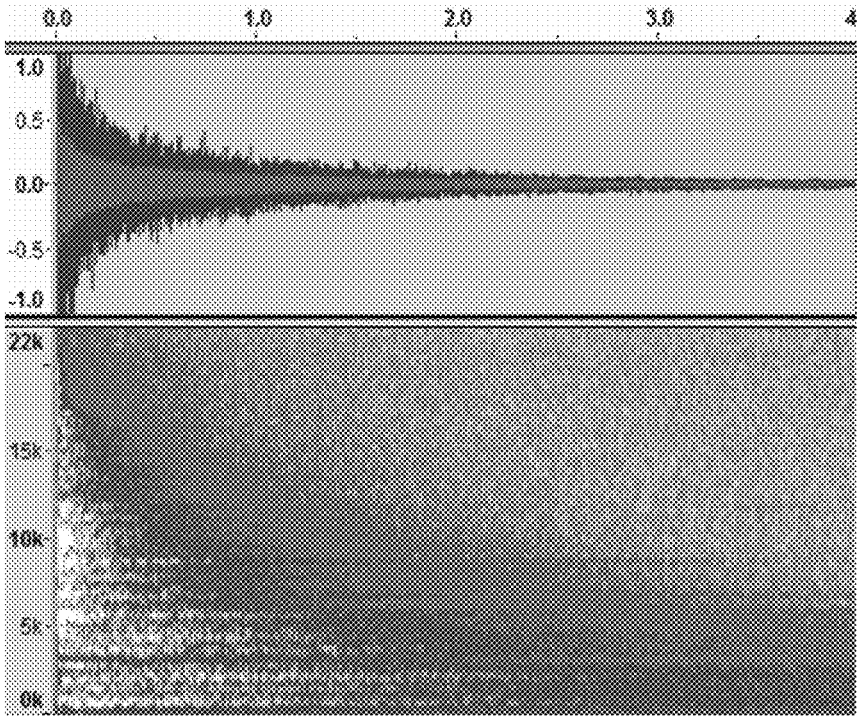
FIG. 5B is a graph showing an output result of beat sounds regarding Comparative example 2.
Figure 6A:
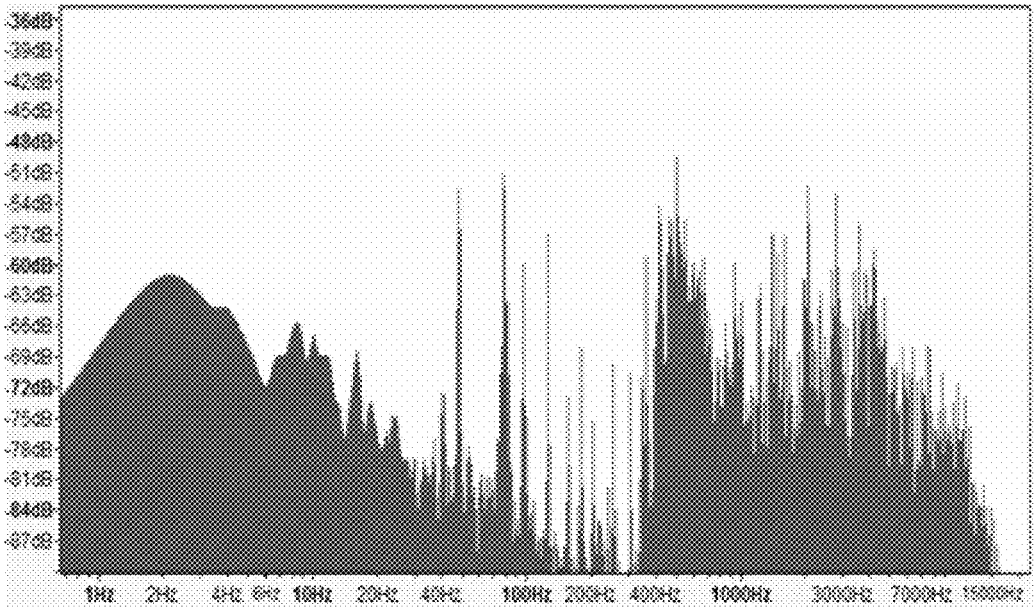
FIG. 6A is a graph showing results of frequency analyses regarding Example 13 and Comparative example 2.
Figure 6B:
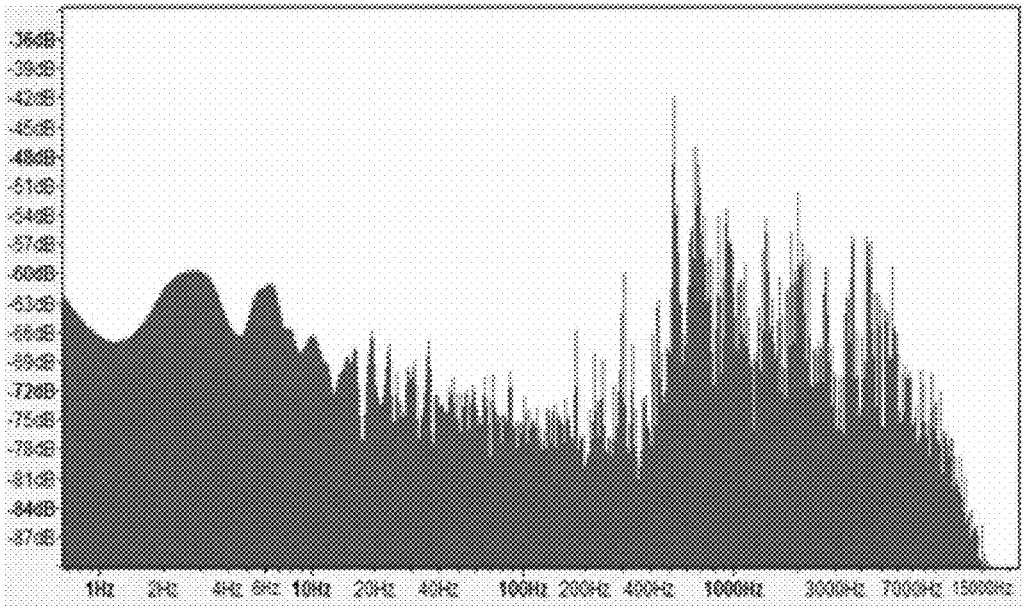
FIG. 6B is a graph showing a result of frequency analysis regarding Comparative example 2.
Figure 7A:
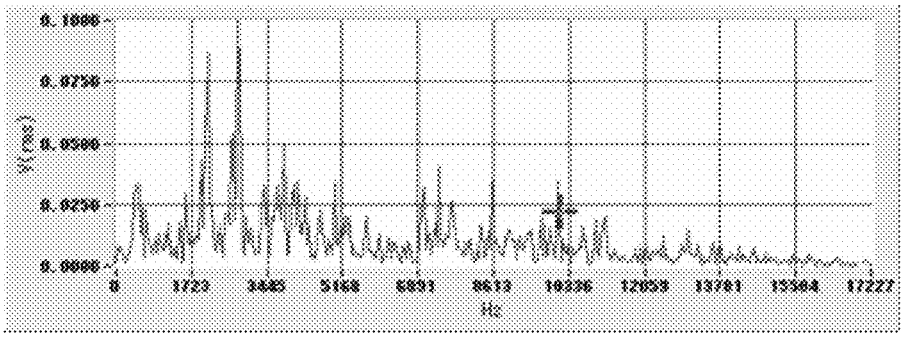
FIG. 7A is a graph showing a result of an instantaneous frequency analysis of beat sounds regarding Example 15.
Figure 7A:
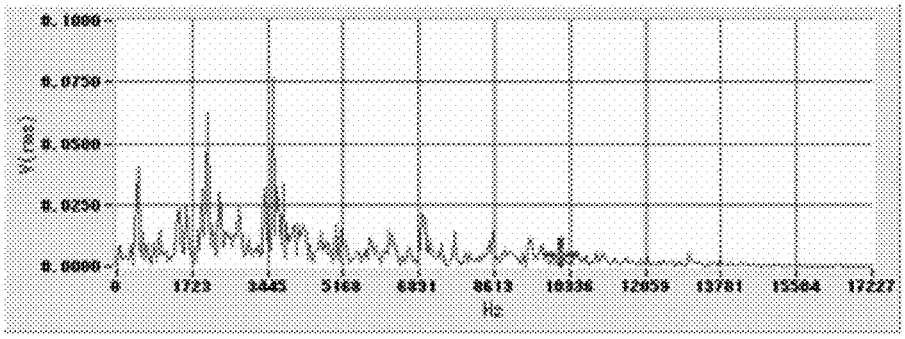
Figure 7A:
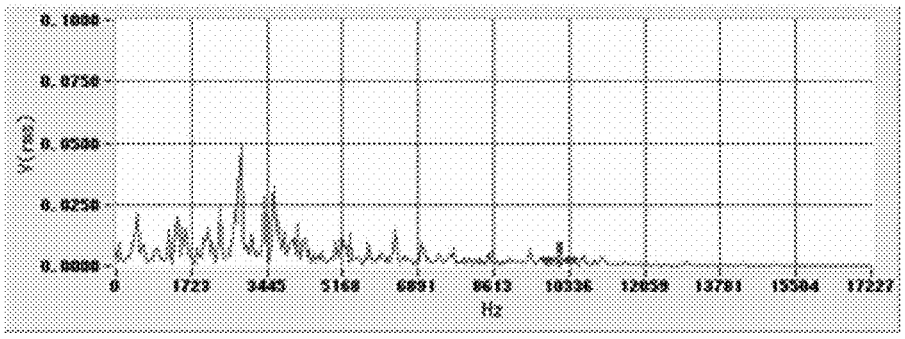
Figure 7A:
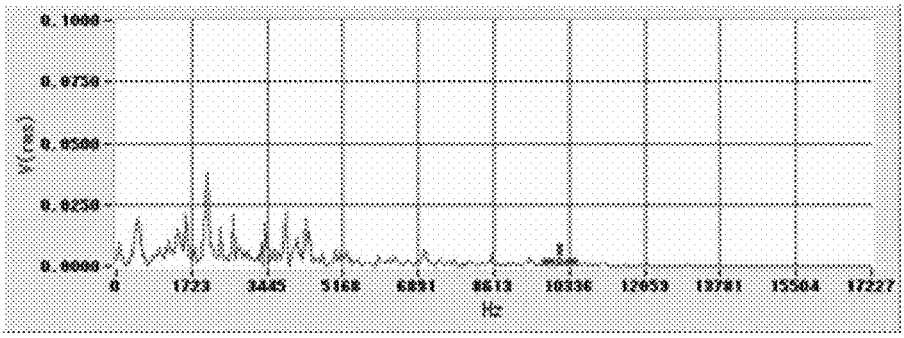
Figure 7B:
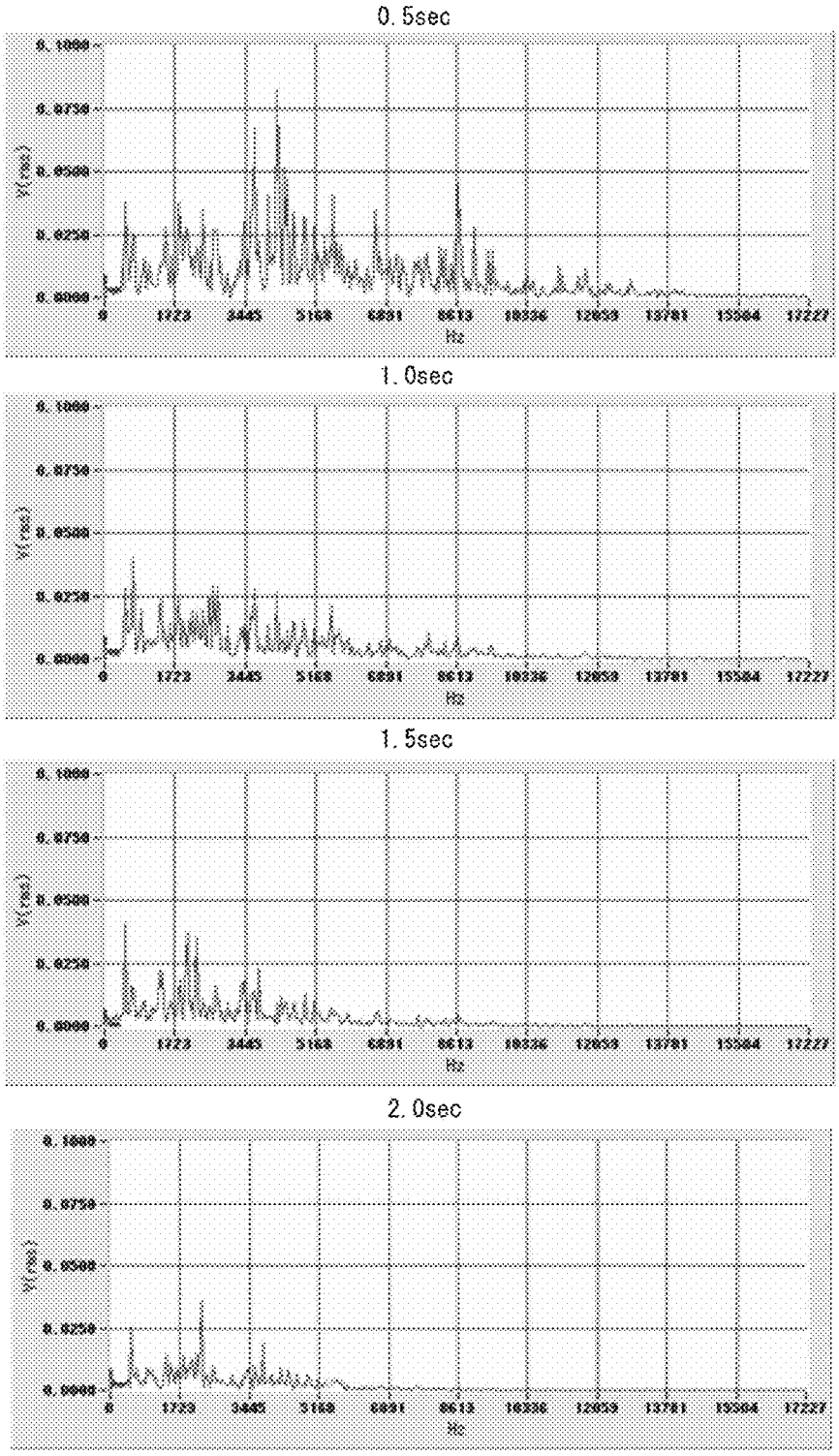
FIG. 7B is a graph showing a result of an instantaneous frequency analysis of beat sounds regarding Comparative example 2.

Then, for beat sounds for 4 seconds after the stroke, the temporal transition of a sound pressure level and a spectrographic wave shape were output, and frequency analysis was performed. FIG. 5 shows an output result of beat sounds relating to Example 13 (FIG. 5A) and an output result of beat sounds relating to Comparative example 2 (FIG. 5B). Regarding the sound pressure level, time (second) is plotted in the horizontal axis and the intensity of sound pressure (amplitude) is plotted in the vertical axis. In the case of the spectrographic wave shape, time is plotted in the horizontal axis and frequency (kHz) is plotted in the vertical axis, and intensities of sound for every frequency (frequency component) are shown by color. FIG. 6 is a graph showing a frequency analysis result for 4 seconds relating to Example 13 (FIG. 6A) and a frequency analysis result for 4 seconds relating to Comparative example 2 (FIG. 6B). In the graph, frequency (kHz) is plotted in the horizontal axis and the intensity of sound pressure (amplitude) is plotted in the vertical axis. The measurement time of 4 seconds shown in FIG. 5 was set to be the range for analyzing acoustic characteristics since the measurement time was the time from the start of stroke until peak components of the intensity of sound pressure almost disappeared in the whole frequency zone, on the basis of previous measurement results. Furthermore, the time from the start of stroke until peak components of the intensity of sound pressure almost disappeared was calculated as reverberation time. The calculated reverberation time is shown in Table 2.

From results of frequency analysis shown in FIG. 6, it is known that, in Example 13 as compared with Comparative example 2, higher harmonic components are remarkably large in the range of 40 Hz to 400 Hz and the enhancement of sound qualities such as complexity of beat sounds, profound feeling and easy audibility is found to be obtained.

FIG. 7 is a graph showing a result of performing instantaneous frequency analysis at a prescribed timing of beat sounds. FIG. 7A shows an analysis result relating to Example 15 and FIG. 7B shows an analysis result relating to Comparative example 2. Each shows a frequency analysis result of beat sounds measured at timings of 0.5 sec, 1 sec, 1.5 sec and 2 sec after the stroke, from the top. Frequency (Hz) is plotted in the horizontal axis and an effective value (rms) is plotted in the vertical axis. When comparing both, in Example 15, larger peaks are generated at the timings of 0.5 sec and 1 sec, and means that large sound energy is generated immediately after the stroke. Accordingly, it is known that the cymbal gives large beat sounds immediately after the stroke and easily sounds.

Figure 8A:
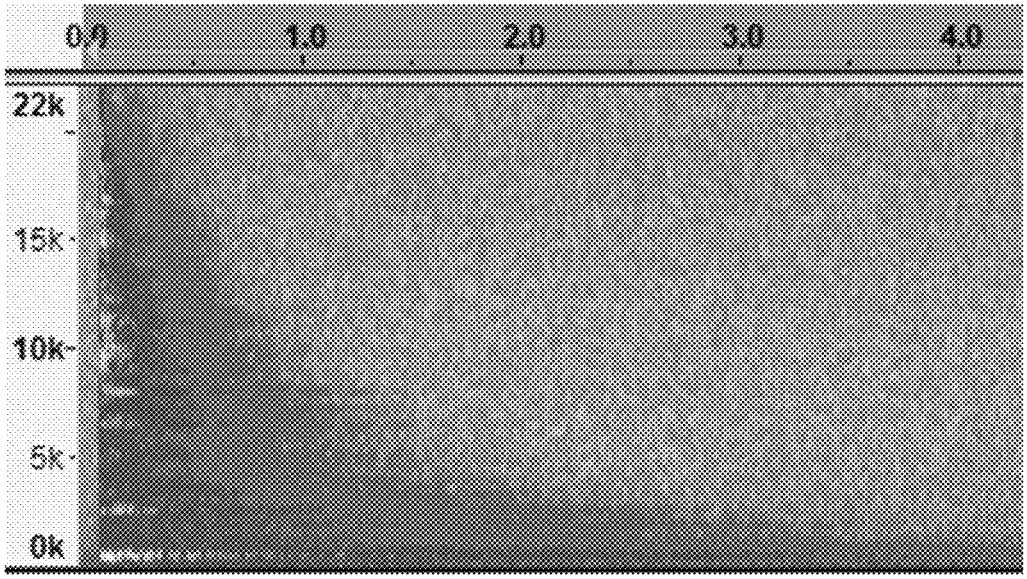
FIG. 8A is a spectrographic wave shape within reverberation time of beat sounds regarding Example 7.
Figure 8B:
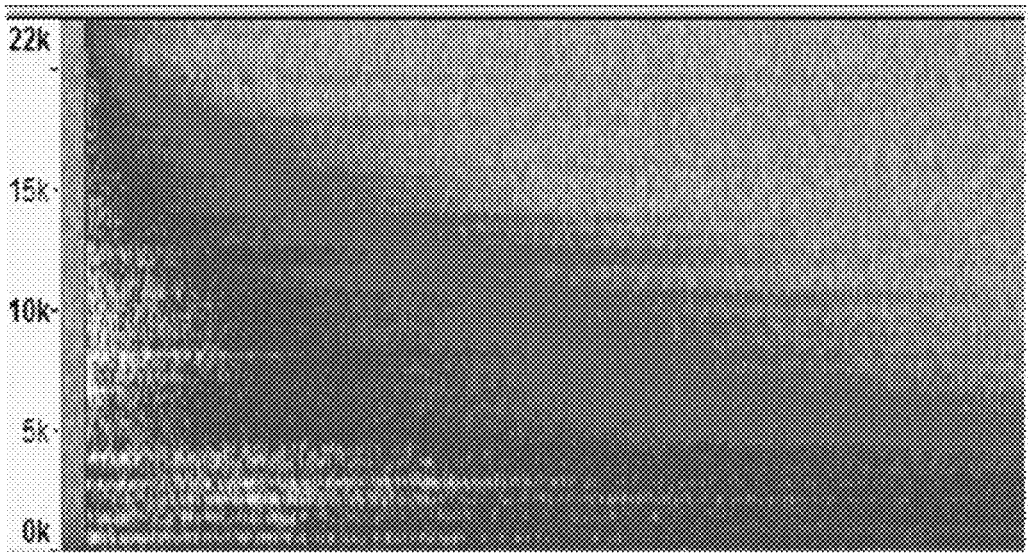
FIG. 8B is a spectrographic wave shape within reverberation time of beat sounds when P is not added in Example 7.

FIG. 8 shows a spectrographic wave shape within the measurement time of 4 seconds, and shows a case relating to Example 7 (FIG. 8A) and a case where P is not added in Example 7 (FIG. 8B). In Example 7, a case where P is added shows more rapid attenuation of beat sounds than the case where P is not added, and it is known that attenuation characteristics can be adjusted by addition of P. Furthermore, as shown in Examples 15 to 21 in Table 2, reverberation time becomes longer by addition of Ti, and attenuation characteristics can also be adjusted even by addition of Ti. Moreover, in comparative example 3, reverberation time becomes shorter, which shows that the cymbal does not easily sound, but as described above in Examples, reverberation time becomes longer than in Comparative example and thus the cymbal easily sounds, which shows that adjustment of reverberation time is possible.

TABLE 2

| | No. | TENSILE STRENGTH ($N/mm^2$) | ELONGATION | AVERAGE CRYSTAL GRAIN DIAMETER (μm) | HARDNESS (HV) | REVERBERATION TIME |
|---|---|---|---|---|---|---|
| EXAMPLE | 1 | 584 | 14% | 300 | 300 OR MORE | 3.5 SEC |
| | 2 | 576 | 17% | 300 | 300 OR MORE | 3.5 SEC |
| | 3 | 581 | 15% | 270 | 300 OR MORE | 3 SEC |
| | 4 | 583 | 16% | 280 | 300 OR MORE | 3 SEC |
| | 5 | 589 | 14% | 270 | 300 OR MORE | 2.5 SEC |
| | 6 | 583 | 15% | 240 | 300 OR MORE | 2.5 SEC |
| | 7 | 593 | 16% | 250 | 300 OR MORE | 2 SEC |
| | 8 | 402 | 9% | 1000 | 190 | 4 SEC OR MORE |
| | 9 | 526 | 16% | 700 | 200 | 4 SEC OR MORE |
| | 10 | 506 | 15% | 390 | 240 | 4 SEC OR MORE |
| | 11 | 535 | 17% | 350 | 264 | 4 SEC OR MORE |
| | 12 | 506 | 16% | 310 | 285 | 2.5 SEC |
| | 13 | 573 | 17% | 270 | 294 | 2.5 SEC |
| | 14 | 577 | 16% | 290 | 292 | 2.5 SEC |
| | 15 | 501 | 16% | 1000 | 190 | 4 SEC OR MORE |
| | 16 | 503 | 15% | 700 | 210 | 4 SEC OR MORE |
| | 17 | 524 | 17% | 400 | 214 | 4 SEC OR MORE |
| | 18 | 548 | 21% | 330 | 216 | 4 SEC |
| | 19 | 565 | 19% | 260 | 212 | 4 SEC |
| | 20 | 572 | 22% | 270 | 217 | 3 SEC |
| | 21 | 570 | 21% | 260 | 220 | 3 SEC |
| | 22 | 513 | 14% | 300 | 220 | 4 SEC OR MORE |
| | 23 | 539 | 17% | 250 | 216 | 4 SEC OR MORE |
| | 24 | 559 | 16% | 270 | 217 | 3 SEC |
| COMPARATIVE EXAMPLE | 25 | 420 | 11% | 2500 | 195 | 4 SEC OR MORE |
| | 26 | 430 | 15% | — | 190 | 2.5 SEC |
| | 27 | 575 | 16% | 250 | 300 OR MORE | 0.5 SEC OR LESS |

INDUSTRIAL APPLICABILITY

As described above, the bronze alloy for a musical instrument according to the present invention is provided with high strength and processability, and is further provided with excellent acoustic characteristics. Therefore, the bronze alloy can be used for various percussion instruments such as a church bell that is a representative of bell metals, a tom-tom, a gong bell, a crotale and an Orin, in addition to the cymbal in Examples.

Furthermore, in the bronze alloy for a musical instrument according to the present invention, crystal grains are micronized by containing Zr, and there is improved processability of copper alloys, of which it has been considered that plastic processing is difficult and the yield is lowered. The modification technology by addition of Zr can be broadly applied to metal materials such as copper and copper alloys, and thus the enhancement of yield in cold-processing and hot-processing can be expected to thereby make mass production possible. In addition, since Zr is added in a minute amount, the influence on the electric conductivity and thermal conductivity of metal materials is small. Thus, utilization for molding processing of metal materials can be expected.

For example, in the case of a material plastic processing of which is difficult, such as Ti-addition type bronze for an $Nb_3Sn$ superconducting wire, in the existing circumstances, only bronze having composition containing up to 16% by mass of Sn can be processed. Processability can be enhanced even when the composition ratio of Sn is raised, by micronizing crystal grains through addition of Zr to such a material. Consequently, molding processing of a superconducting wire having a high composition ratio of Sn becomes possible. The diffusion area of Sn to Nb increases by raising the composition ratio of Sn, and in the processed final wire material, performance of $Nb_3Sn$ is enhanced. A superconducting wire having an enhanced performance can be applied to a field of an accelerator and applications to a wide range of fields are expected.

What is claimed is:

1. A bronze alloy for a musical instrument, having a component composition containing 18% by mass to 26% by mass of Sn, 0.0005% by mass to 0.25% by mass of Zr, and a remainder consisting of Cu and inevitable impurities.

2. A bronze alloy for a musical instrument, having a component composition containing 18% by mass to 26% by mass of Sn, 0.0005% by mass to 0.25% by mass of Zr, one kind or two kinds of 0.1% by mass to 1.0% by mass of Ti and 0.001% by mass to 1.0% by mass of P, and a remainder consisting of Cu and inevitable impurities.

3. The bronze alloy for a musical instrument according to claim 1, having a component composition further containing one kind or two kinds of 0.005% by mass to 0.1% by mass of Ag and 0.01% by mass to 0.1% by mass of Fe.

4. A percussion instrument that is molded using the bronze alloy for a musical instrument according to claim 1.

5. The bronze alloy for a musical instrument according to claim 2, having a component composition further containing one kind or two kinds of 0.005% by mass to 0.1% by mass of Ag and 0.01% by mass to 0.1% by mass of Fe.

6. A percussion instrument that is molded using the bronze alloy for a musical instrument according to claim 2.

7. A percussion instrument that is molded using the bronze alloy for a musical instrument according to claim 3.

8. A percussion instrument that is molded using the bronze alloy for a musical instrument according to claim 5.

* * * * *